US011692369B2

(12) United States Patent
Tao et al.

(10) Patent No.: US 11,692,369 B2
(45) Date of Patent: Jul. 4, 2023

(54) OUTDOOR BARBECUE TENT CAPABLE OF QUICK ASSEMBLING AND FOLDING

(71) Applicant: NINGBO SOMLE AUDIO-VISUAL TECHNOLOGY CO., LTD, Ningbo (CN)

(72) Inventors: Liming Tao, Ningbo (CN); Kaili Chen, Ningbo (CN)

(73) Assignee: NINGBO SOMLE AUDIO-VISUAL TECHNOLOGY CO., LTD, Ningbo (CN)

( * ) Notice: Subject to any disclaimer, the term of this patent is extended or adjusted under 35 U.S.C. 154(b) by 0 days.

(21) Appl. No.: 17/358,715

(22) Filed: Jun. 25, 2021

(65) Prior Publication Data

US 2022/0412119 A1 Dec. 29, 2022

(51) Int. Cl.

| | |
|---|---|
| ***E04H 15/46*** | (2006.01) |
| ***E04H 15/02*** | (2006.01) |
| ***E04H 15/50*** | (2006.01) |

(52) U.S. Cl.

CPC ..... *E04H 15/46* (2013.01); *E04H 15/02* (2013.01); *E04H 15/50* (2013.01)

(58) Field of Classification Search

None

See application file for complete search history.

(56) References Cited

U.S. PATENT DOCUMENTS

| | | | | |
|---|---|---|---|---|
| 1,100,310 A * | 6/1914 | Lazarus et al. | ..... | E04H 15/46 135/902 |
| 1,796,567 A * | 3/1931 | Josephl | ..... | E04H 15/04 135/90 |
| 9,394,719 B2 * | 7/2016 | Choi | ..... | E04H 15/02 |
| 10,125,516 B2 * | 11/2018 | Stehly | ..... | E04H 1/1272 |

FOREIGN PATENT DOCUMENTS

| | | | | |
|---|---|---|---|---|
| CN | 212325780 U * | 1/2021 | ..... | A47B 3/083 |

* cited by examiner

*Primary Examiner* — David R Dunn
*Assistant Examiner* — Danielle Jackson
(74) *Attorney, Agent, or Firm* — Zhigang Ma

(57) ABSTRACT

An outdoor barbecue tent capable of quick assembling and folding includes a tent body and a shelf. The tent body includes a sunshade part and at least two fixed columns arranged on the sunshade part. A movable column relatively movably mounted to each of the at least two fixed columns, and two diagonal positions of the shelf are mounted with a supporting rod respectively, the supporting rods are connected to the fixed columns, and the shelf is connected to the fixed columns. The structure thereof utilizes the foldability of the folding tent body, the retractability of the movable column, and the convenient mounting of the shelf to achieve the ease assembling of the shelf, and greatly reduces the time of assembling the outdoor barbecue tent capable of quick assembling and folding.

9 Claims, 9 Drawing Sheets

OUTDOOR BARBECUE TENT CAPABLE OF QUICK ASSEMBLING AND FOLDING

TECHNICAL FIELD

The present invention relates to an apparatus for outdoor barbecue, and in particular, to an outdoor barbecue tent capable of quick assembling and folding.

BACKGROUND

An outdoor barbecue tent provides a sun-shading function for customers during barbecue, but the structure of a current barbecue tent that can be carried out is generally a split detachable structure. Most of involved components are in threaded connection, which takes a lot of time for disassembling and assembling. Moreover, professional tools are required for assembling and detaching, which consumes a lot of manpower, material resources, and time, and is not convenient to use. The detached parts still occupy a large space and are not easy to store. At the same time, there are many main components and scattered components, which make it difficult to match and connect the various components. It is time-consuming and heavy after storage. At present, a shelf arranged on a tent body is welded and fixed to columns, which leads to the inability to separate the columns and the shelf after the tent body is detached, so that the detached and separated tent body components still have a large volume and are inconvenient to carry. Based on the above defects, the existing outdoor barbecue tent has poor use performance.

SUMMARY OF THE INVENTION

An objective of the present invention is to overcome the above technical shortcomings and design an outdoor barbecue tent capable of quick assembling and folding having a specific structure as follows.

The outdoor barbecue tent capable of quick assembling and folding designed by the present invention includes a tent body and a shelf. The tent body includes a folding frame and at least two fixed columns arranged on the folding frame. A movable column is relatively movablely mounted or detachably mounted on each of the at least two fixed columns, a supporting rod is mounted on the shelf, the lower end of the supporting rod away from the shelf is detachably connected to the fixed column, and the shelf is detachably connected to the fixed column, so that the shelf is mounted on the fixed column.

Preferably, the shelf is fitted with supporting rods on both diagonal portions, or with supporting rods on two opposite corners on one side of the shelf.

Preferably, the shelf is provided with a shaft, and at least two fixed columns or movable columns are provided with perforations, and the shaft is correspondingly inserted into the perforation to position and connect the shelf.

Preferably, an outer end of the shaft is provided with a limiting body, and the diameter of the limiting body is greater than that of the perforation.

Preferably, a pre-insertion hole in communication with the perforation is arranged beside the perforation, the diameter of the pre-insertion hole is greater than that of the limiting body, and the diameter of the perforation is smaller than that of the pre-insertion hole.

Preferably, a positioning component is further included, wherein a connecting groove is arranged on the fixed column, a first hole is arranged on an inner wall of the connecting groove, the other end of the supporting rod is provided with a second hole, and the positioning component is placed in the first hole and the second hole, for fixing a position state of the supporting rod and fixedly supporting the shelf.

Preferably, the positioning component is a bolt, and the first hole or the second hole and the bolt are in threaded connection.

Preferably, the positioning component includes a pull ring and a rod, one end of the rod close to the fixed column is placed in the first hole and the second hole, the pull ring is arranged at the end of the rod away from the fixed column, and the end of the rod close to the fixed column is mounted in the first hole after penetrating an elastic reset apparatus, the elastic reset apparatus includes a lock sleeve located in a position area of the first hole and a first spring placed in the lock sleeve, the middle of the rod is placed in the lock sleeve, the other end of the rod penetrates through the lock sleeve, the middle of the rod is provided with a step, and two ends of the first spring respectively abut against the step and an inner wall of an end of the lock sleeve.

Preferably, a positioning sleeve is further included, wherein the connecting groove is arranged on the positioning sleeve, the fixed column includes an elongated cavity, the movable column is inserted into the elongated cavity from a lower end of the fixed column, the positioning sleeve is sleeved on the lower end of the fixed column, the lower end of the fixed column is provided with a lock hole, at least one of the upper, middle, and lower ends of the movable column is provided with at least one telescopic positioning hole, positions of the lock hole and the telescopic positioning hole correspond to each other, and the fixed column is provided with an elastic latch, the elastic latch includes a pin and a second spring, the positioning sleeve is provided with a through hole corresponding to the position of the lock hole, and the pin is mounted in the through hole through the second spring, so that the pin is kept inserted into the lock hole and the telescopic positioning hole to lock an extended state of the movable column.

Preferably, a mounting groove is arranged on the positioning sleeve at a position where the through hole is located, a button is arranged at an outer end of the pin, the button is hinged to an inner wall of the mounting groove through a pin shaft, the button includes a driving part, and there is a gap between the driving part and the positioning sleeve; the second spring is sleeved on the pin shaft of the hinged connection of the button, and two end extension portions of the second spring are respectively connected to the positioning sleeve and the button.

Preferably, the positioning sleeve is provided with a positioning groove, the button is provided with a slot, one end extension portion of the second spring is placed in the positioning groove, and the other end extension portion is located in the slot.

Preferably, the supporting rod is provided with an oblique groove body, and the supporting rod with the oblique groove body arranged forms a pointed portion.

Preferably, a hook is arranged on the shelf.

Preferably, a slot is arranged on an inner wall portion of the connecting groove, a nut is fixed in the slot, and a threaded hole of the nut corresponds to the first hole, so that a screw of the bolt penetrates through the first hole and then is inserted into the threaded hole of the nut for threaded connection.

For the outdoor barbecue tent capable of quick assembling and folding designed by the present invention, its structure utilizes the foldability of the folding tent body, the retractability of the movable column, and the convenient mounting of the shelf to achieve the ease assembling of the shelf, and greatly reduces the time of assembling the outdoor barbecue tent. Moreover, the barbecue tent after folding has a small volume and is easy to carry, and the shelf is stable and reliable after assembly. At the same time, the shelf can be detached on the column, thus completely solving the technical problem that the current detachable separated tent body or foldable tent body still has a relatively large volume after being folded and is inconvenient to carry since the columns and the shelf of the tent body cannot be detached.

DETAILED DESCRIPTION

Figure 1:
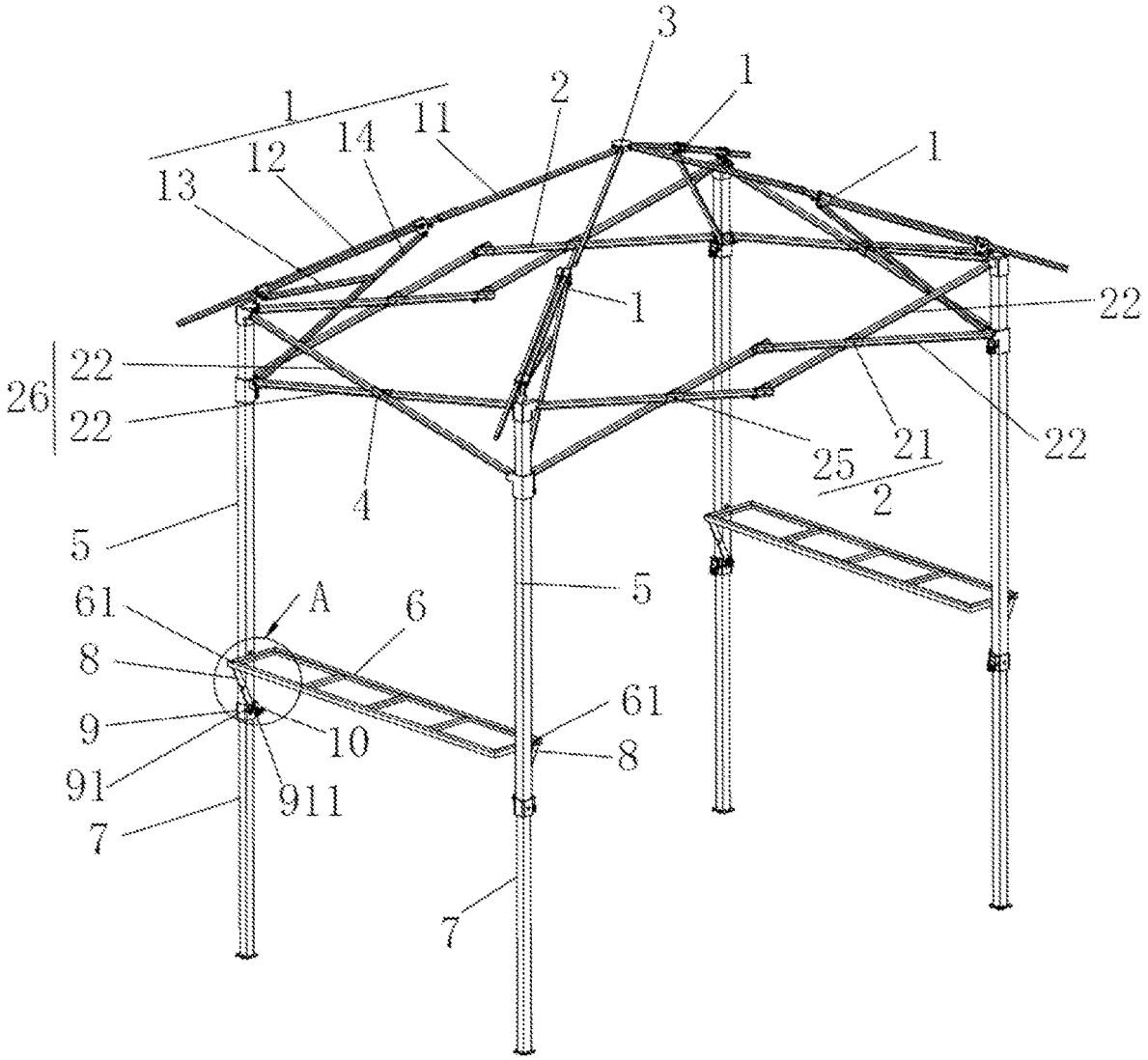
FIG. 1 is a first schematic diagram of an overall structure of a barbecue tent with the other end of a supporting rod connected to a connecting groove by a bolt.
Figure 2:
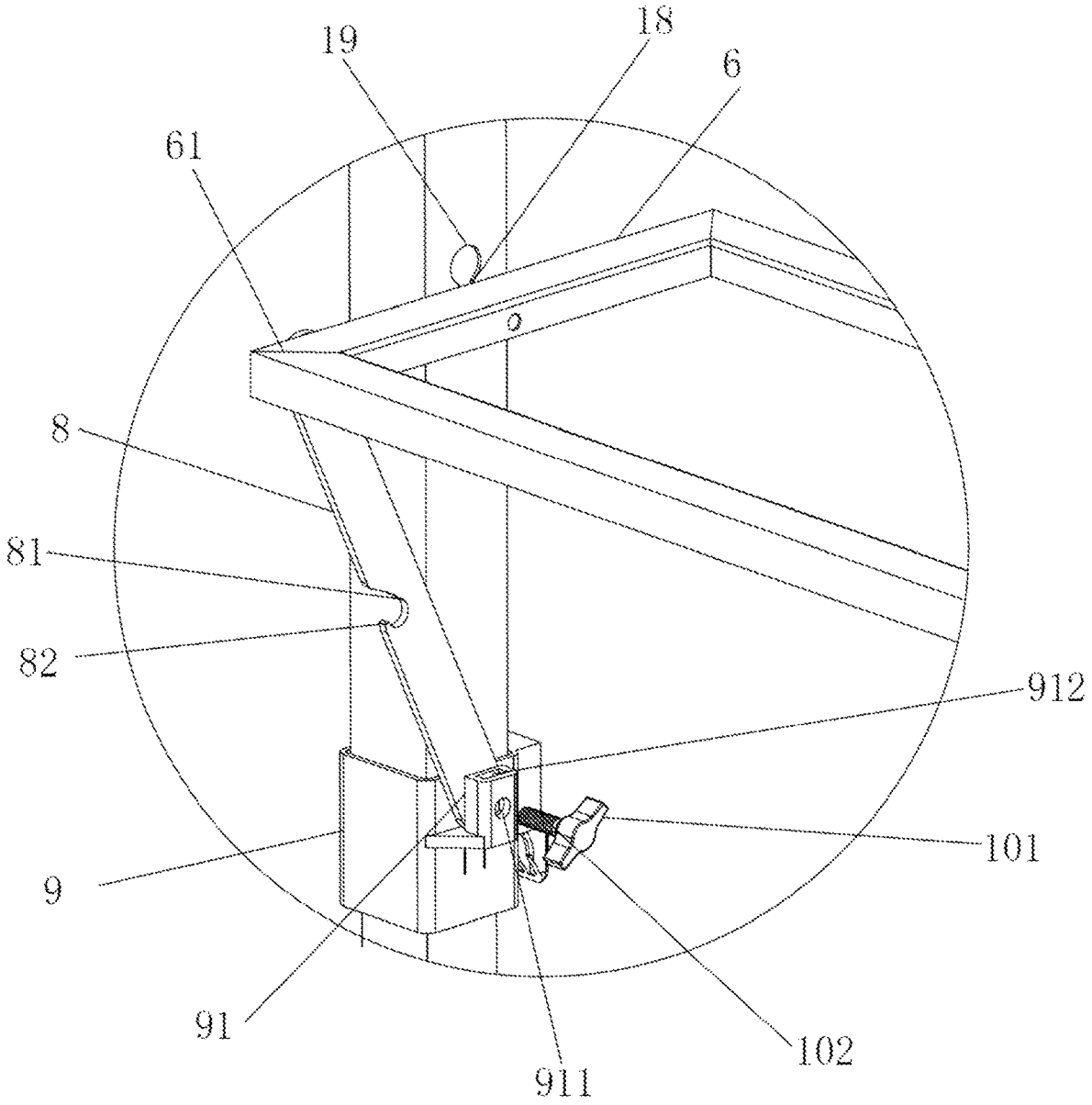
FIG. 2 is a partial enlarged diagram of A.
Figure 3:
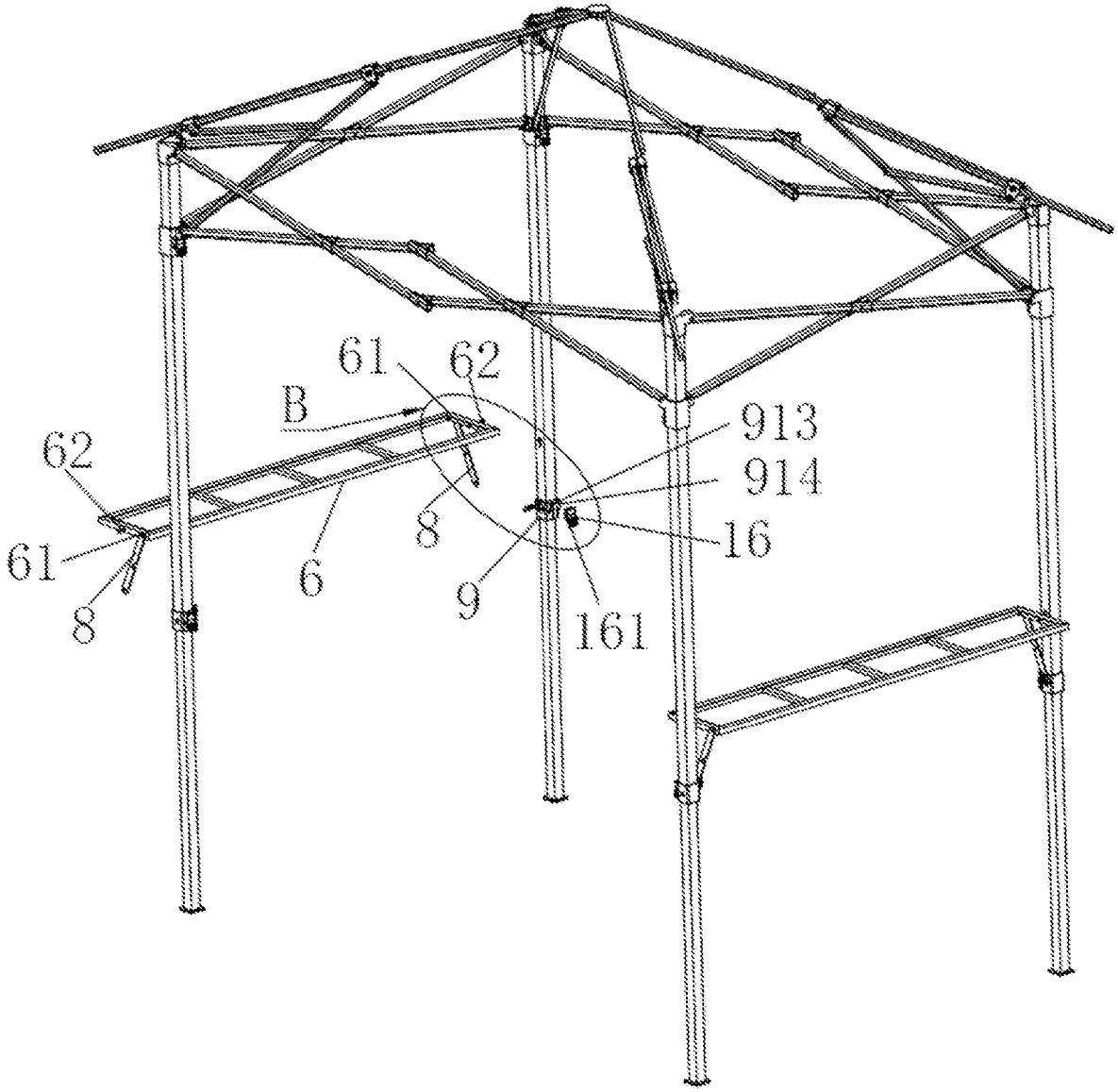
FIG. 3 is a second schematic diagram of an overall structure of a barbecue tent with the other end of a supporting rod connected to a connecting groove by a bolt.
Figure 4:
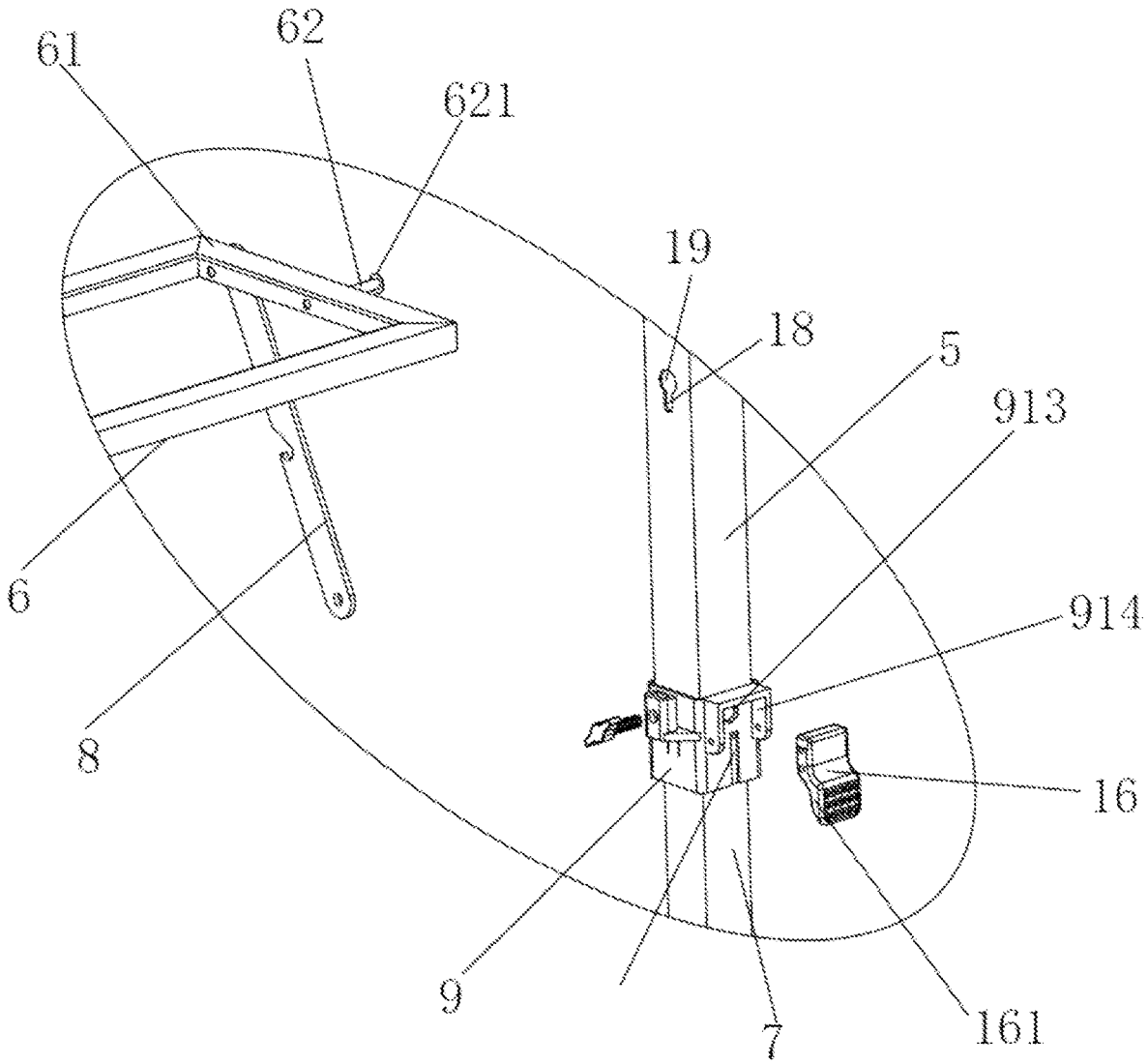
FIG. 4 is an enlarged diagram of B.
Figure 5:
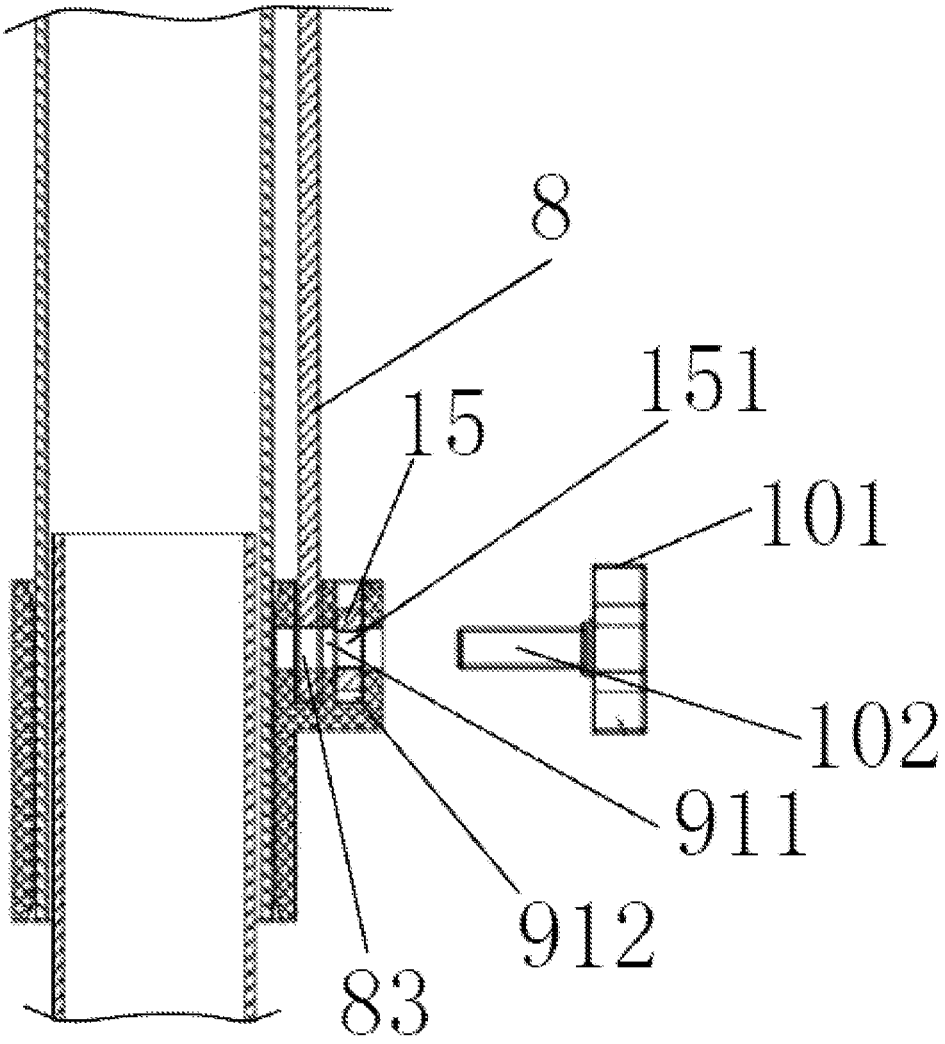
FIG. 5 is a cross-sectional diagram of a partial structure with the other end of a supporting rod connected to a connecting groove by a bolt.
Figure 6:
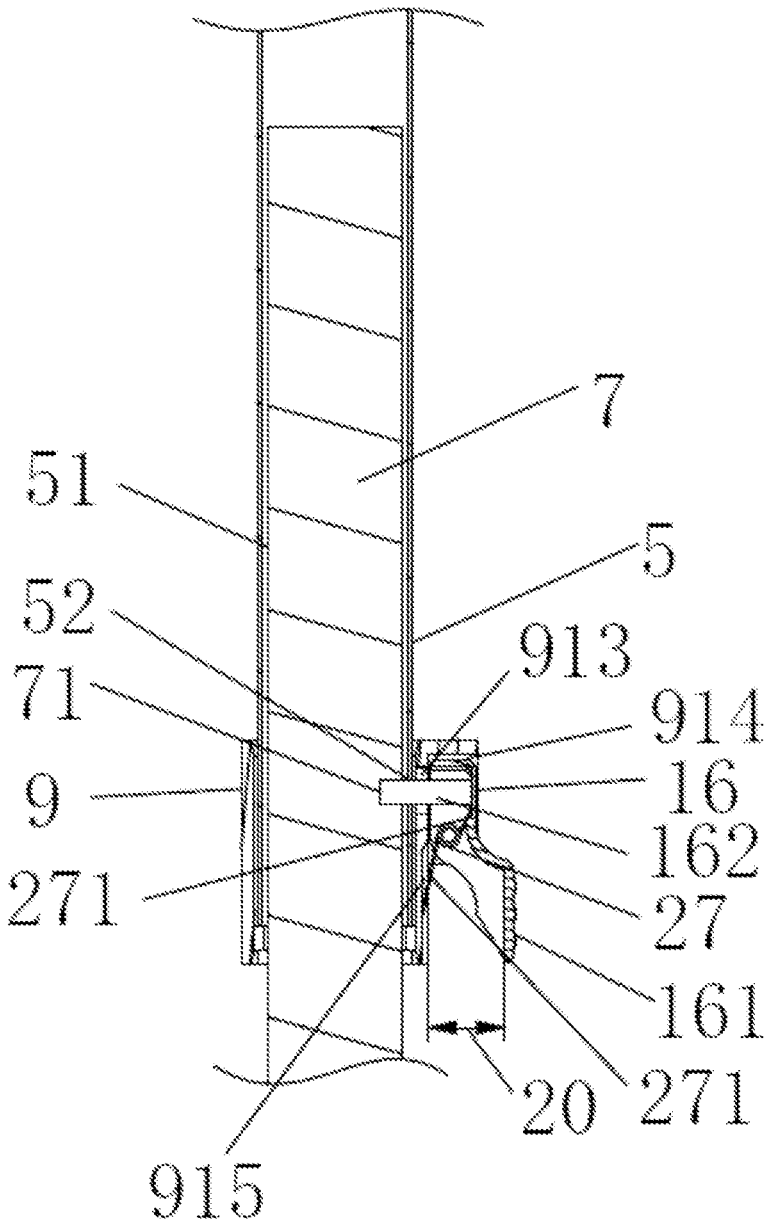
FIG. 6 is a cross-sectional diagram of a partial structure with a movable column locked on a fixed column by an elastic latch.
Figure 7:
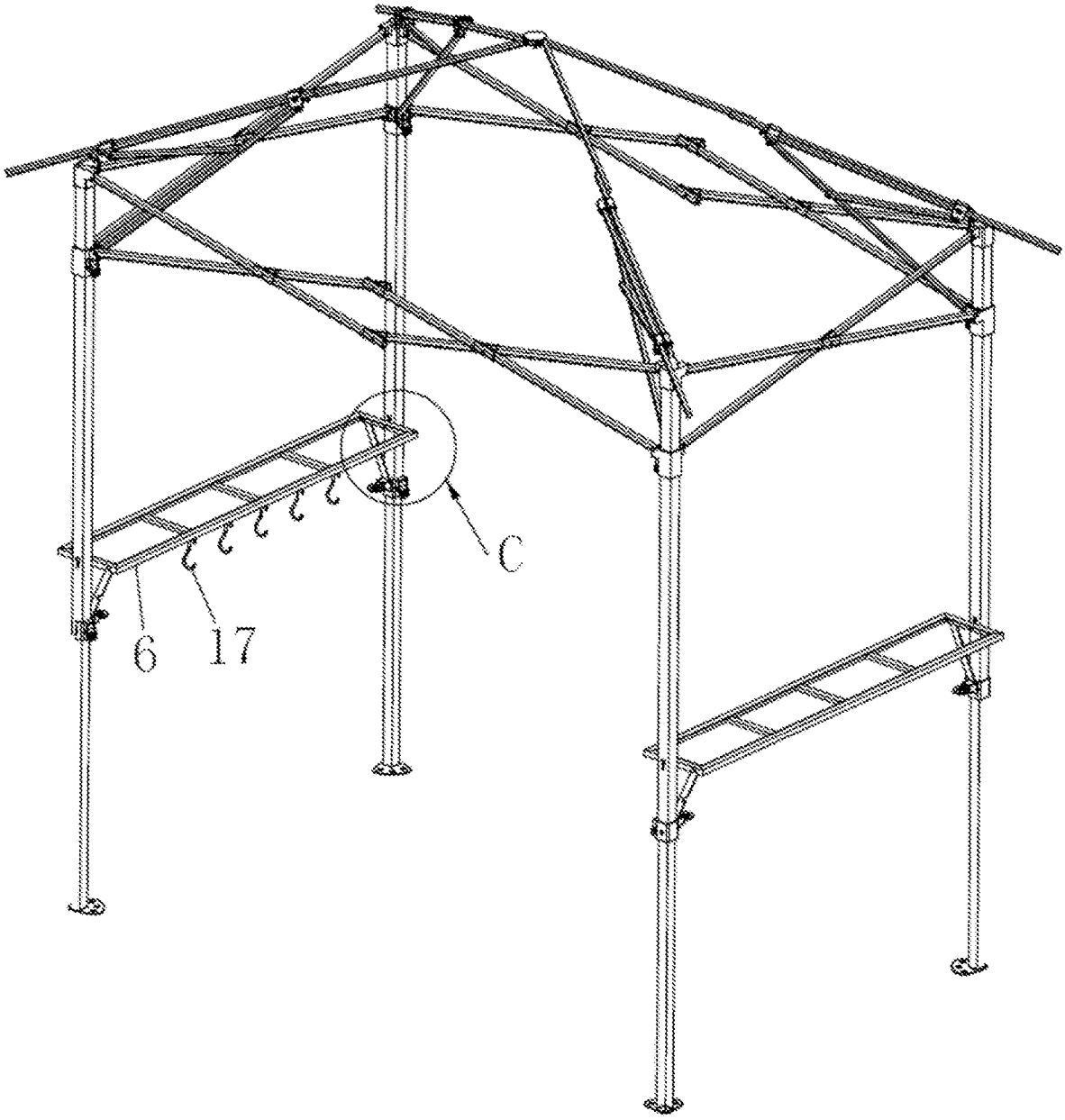
FIG. 7 is a schematic diagram of an overall structure of a barbecue tent with the other end of a supporting rod connected to a connecting groove by a rod.
Figure 8:
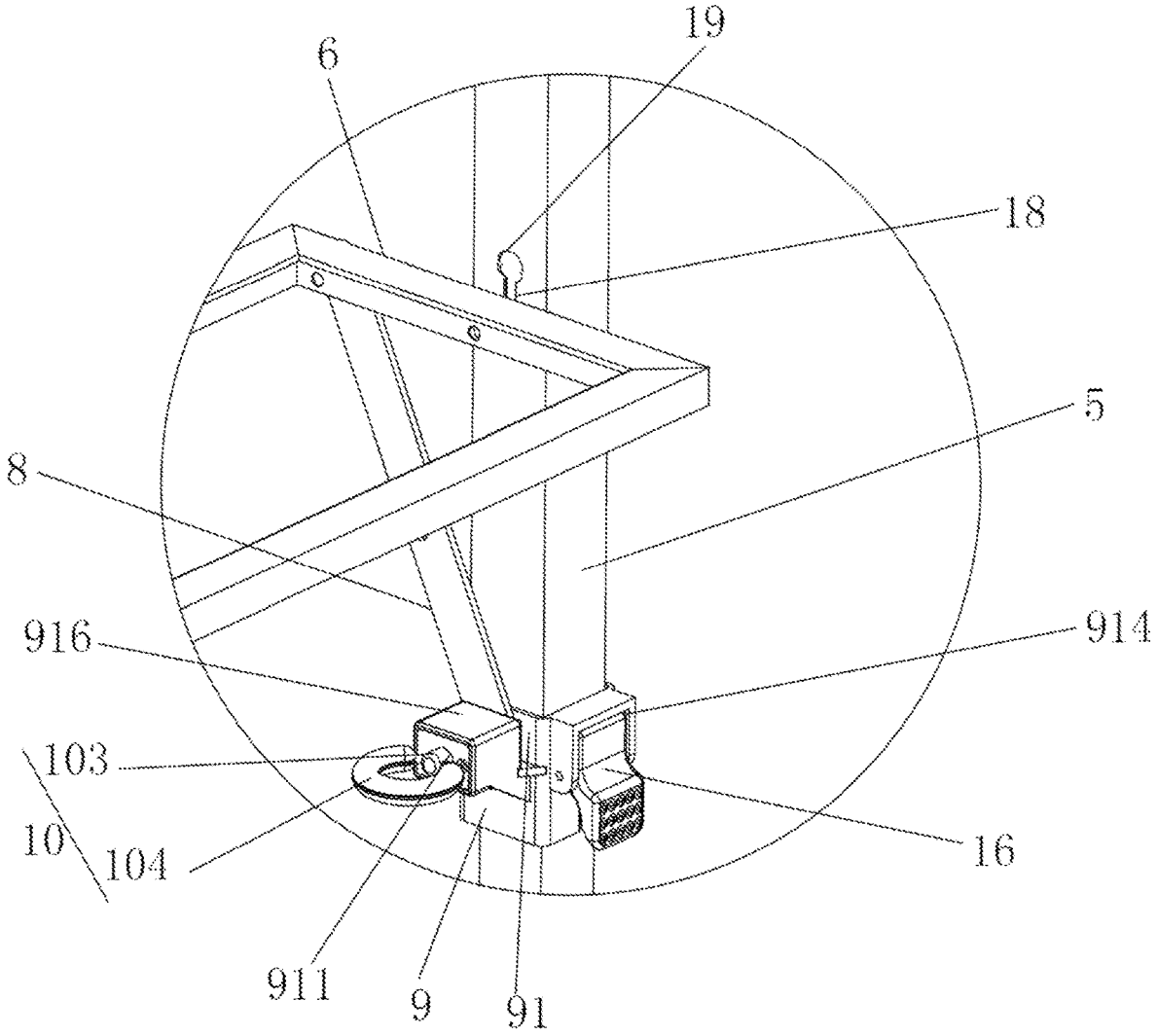
FIG. 8 is a partial enlarged diagram of C.
Figure 9:
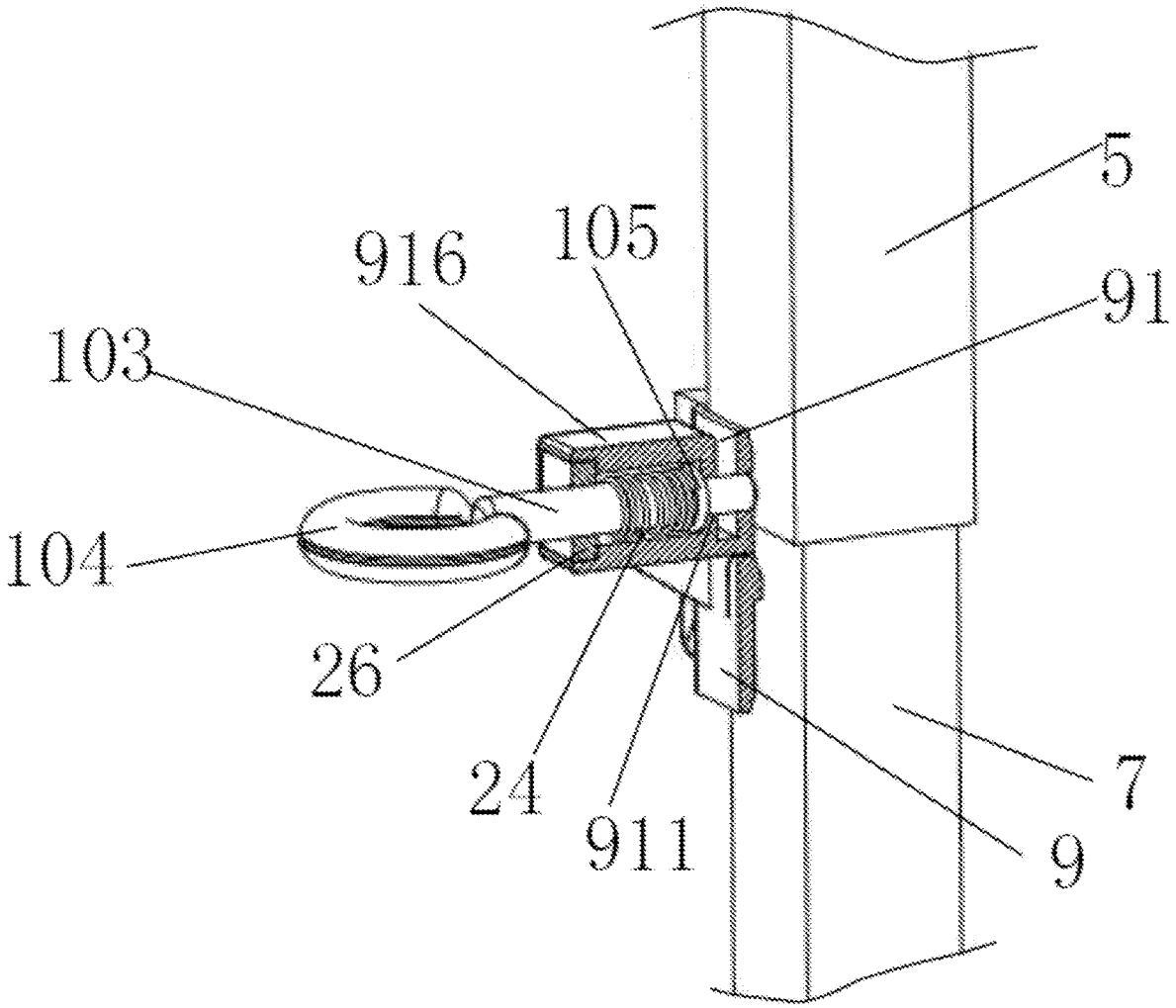
FIG. 9 is a cross-sectional diagram of a partial structure with the other end of a supporting rod connected to a connecting groove by a rod.
Figure 10:
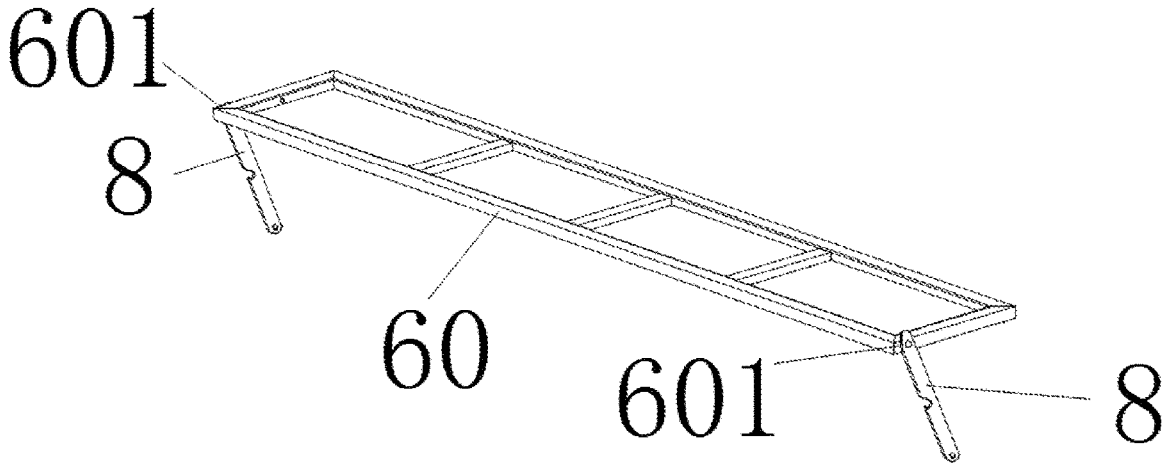
FIG. 10 is a schematic diagram of connection of a shelf and a supporting rod.

The technical solutions in the embodiments of the present invention will be clearly and completely described below with reference to the accompanying drawings in the embodiments of the present invention. Obviously, the described embodiments are only a part of the embodiments of the present invention, rather than all the embodiments. Based on the embodiments of the present invention, all other embodiments obtained by those of ordinary skill in the art fall within the protection scope of the present invention.

EMBODIMENT

As shown in the accompanying drawings, the outdoor barbecue tent capable of quick assembling and folding described in the present embodiment includes a tent body and shelf 6. The tent body includes a folding frame and at least two fixed columns 5 arranged on the folding frame. Movable column 7 is relatively movably mounted or detachably mounted on each of two fixed columns 5. Supporting rod 8 is mounted on shelf 6, and the lower end of supporting rod 8 away from the shelf is detachably connected to fixed column 5. Shelf 6 is detachably connected to fixed column 5, so that the shelf is mounted on the fixed column. The detachable mounting of movable column 7 and fixed column 5 may be fixedly connecting a top end of movable column 7 and a bottom end of fixed column 5 by bolt connection, and the top end of movable column 7 can be directly separated from the bottom end of fixed column 5 by removing the bolt during detaching. Moreover, supporting rod 8 may be fixedly connected to diagonal portions 61 by welding or bolts, or may be hinged to diagonal portions 61 by pin shafts. The shelf may be detached on the column, thus completely solving the technical problem that the current detachable separated tent body or foldable tent body still has a relatively large volume after being folded and is inconvenient to carry since the columns and the shelf of the tent body cannot be detached. The technical effect that the barbecue tent body is small in volume and easy to carry is achieved.

Preferably, shelf 6 is fitted with supporting rods 8 on both diagonal portions 61, or with supporting rods 8 on two opposite corners 601 on one side of the shelf 6.

Preferably, the number of fixed columns 5 is set to four, and the number of corresponding movable columns 7 is also set to four, so as to form a cube-shaped barbecue tent. The folding frame includes top block 3, four groups of first folding assemblies 1, two groups of second folding assemblies 2, and two groups of third folding assemblies 4. Two groups of second folding assemblies 2 are mounted on front and rear sides of the barbecue tent respectively, two groups of third folding assemblies 4 are mounted on left and right sides of the barbecue tent. Four groups of first folding assemblies 1 each include first folding rod 11, second folding rod 12, a third folding rod 13, and fourth folding rod 14. Top ends of first folding rods 11 of four groups of first folding assemblies 1 are respectively in an annular array of pin shafts hinged to top block 3. Two ends of second folding rod 12 are respectively hinged to the top end of fixed column 5 and the bottom end of first folding rod 11 using pin shafts. Two ends of third folding rod 13 are respectively hinged to the middle of second folding rod 12 and fourth folding rod 14 using pin shafts. Two ends of fourth folding rod 14 are respectively hinged to fixed column 5 and an end of second folding rod 12 using pin shafts. Two groups of second folding assemblies 2 each include first X-shaped folding body 21 and second X-shaped folding body 25. One ends of two folding rods 22 of first X-shaped folding body 21 at the front side are hinged to one fixed column 5 at the front side using pin shafts, and one ends of two folding rods 22 of second X-shaped folding body 25 at the front side are hinged to the other front fixed column 5 using pin shafts. The other ends of two folding rods 22 of first X-shaped folding body 21 at the front side are respectively hinged to the other ends of two folding rods 22 of second X-shaped folding body 25 at the front side using pin shafts. One ends of two folding rods 22 of first X-shaped folding body 21 at the rear side are respectively hinged to one fixed column 5 at the rear side using pin shafts, and one ends of two folding rods 22 of second X-shaped folding body 25 at the rear side are hinged to the other fixed column 5 using pin shafts. The other ends of two folding rods 22 of first X-shaped folding body 21 at the rear side are hinged to the other ends of two folding rods 22 of second X-shaped folding body 25 at the rear side using pin shafts. Two groups of third folding assemblies 4 each include third X-shaped folding body 26. Two ends of two folding rods 22 of third X-shaped folding body 26 on the left side are respectively hinged to two corresponding fixed columns 5 on the left side using pin shafts, and two ends of two folding rods 22 of third X-shaped folding body 26 on the right side are respectively hinged to the other two corresponding fixed columns 5 on the right side using pin shafts. The folding of the folding frame is achieved by mutual rotational action formed by hinged connection of the folding rods using pin shafts, so as to realize that the whole barbecue tent is foldable, thus improving the use performance of the barbecue tent and the convenience in use.

The shelf described above is detachably mounted on the fixed column. Specifically, shelf 6 is provided with shaft 62, fixed column 5 is provided with perforation 18, and shaft 62 is correspondingly inserted into perforation 18 to position and connect shelf 6. On the basis of this design concept, in order to make the shelf to be firmly mounted in the perforation, shafts 62 are provided at both ends of shelf 6, and perforations 18 are arranged on two fixed columns 5. Two shafts 62 are respectively inserted into two perforations 18 to realize the fitting and insertion of two shafts 62 and two perforations 18 to complete stable mounting and improve the use performance. In addition, the shafts may be fixed on the shelf by welding.

Preferably, an outer end of shaft 62 is provided with limiting body 621, the diameter of limiting body 621 is greater than the width of perforation 18. Pre-insertion hole 19 in communication with perforation 18 is arranged beside perforation 18, the diameter of pre-insertion hole 19 is greater than that of limiting body 621, and the diameter of perforation 18 is smaller than that of pre-insertion hole 19. The structure is realized in that shaft 62 with limiting body 621 is inserted into perforation 18 through pre-insertion hole 19, and limiting body 621 is limited at an inner opening edge of perforation 18, so as to achieve fixation of shaft 62, which fully reflects convenience in mounting and detaching, and stability and reliability after mounting.

Preferably, supporting rod 8 is provided with oblique groove body 81, and supporting rod 8 with oblique groove body 81 arranged forms pointed portion 82. The arrangement of pointed portion 82 and oblique groove body 81 can be used for opening a beer bottle cap. At the same time, hook 17 may also be arranged on shelf 6 to facilitate hanging used objects during outdoor barbecue, thereby diversifying the functions of the shelf.

In the present embodiment, positioning component 10 is further provided, connecting groove 91 is arranged on fixed column 5, first hole 911 is arranged on an inner wall of connecting groove 91, and the other end of supporting rod 8 is provided with second hole 83, positioning component is placed in first hole 911 and second hole 83, for fixing a position state of supporting rod 8 and fixedly supporting shelf 6. Preferably, positioning component 10 is bolt 101, and first hole 911 or second hole 83 are in threaded connection with bolt 101. Performing positioning and fixing by using bolt 101 makes it more convenient to use. Bolt 101 is rotated to drive screw 102 for displacement to achieve the positioning and fixing of supporting rod 8. When screw 102 leaves second hole 83, supporting rod 8 is unlocked, and at this time, supporting rod 8 can be separated from connecting groove 91, and then shaft 62 is drawn out from perforation 18 to complete the detaching of shelf 6. After screw 102 is inserted into second hole 83, supporting rod 8 is locked, slot 912 is arranged on an inner wall portion of connecting groove 91, nut 15 is fixed in slot 912 with interference fit, a threaded hole of nut 15 corresponds to first hole 911, so that screw 102 of bolt 101 penetrates through first hole 911 and then is inserted into the threaded hole of nut 15 for threaded connection.

In another embodiment, positioning component 10 includes pull ring 104 and rod 103. One end of rod 103 close to the fixed column is placed in first hole 911 and second hole 912. Pull ring 104 is arranged at the other end of rod 103 away from the fixed column, one end of rod 103 close to the fixed column is mounted in the first hole 911 after penetrating an elastic reset apparatus, the elastic reset apparatus includes lock sleeve 916 located in a position area of first hole 911 and first spring 24 placed in lock sleeve 916, the middle of rod 103 is placed in lock sleeve 916, the other end of rod 103 penetrates through lock sleeve 916, the middle of rod 103 is provided with step 105, wherein limiting plate body 26 is fixed at a port of lock sleeve 916, so that two ends of first spring 24 respectively abut against step 105 and an inner wall of limiting plate body 26 at an end of lock sleeve 916. Therefore, pull ring 104 is used to drive rod 103 to displace to realize the positioning and fixing of supporting rod 8. After rod 103 leaves second hole 83, supporting rod 8 is unlocked, and at this time, supporting rod 8 can be separated from connecting groove 91, and then shaft 62 is drawn out from perforation 18 to complete the detaching of shelf 6. After rod 103 is inserted into second hole 83, supporting rod 8 is locked.

In the present embodiment, positioning sleeve 9 is further provided. Connecting groove 91 is arranged on positioning sleeve 9, fixed column 5 includes elongated cavity 51, movable column 7 is inserted into elongated cavity 51 from a lower end of fixed column 5, positioning sleeve 9 is sleeved on the lower end of fixed column 5, the lower end of fixed column 5 is provided with lock hole 52, at least one of the upper, middle, and lower ends of movable column 7 is provided with at least one telescopic positioning hole 71, positions of lock hole 52 and telescopic positioning hole 71 correspond to each other. Fixed column 5 is provided with an elastic latch, the elastic latch includes pin 162 and second spring 27, positioning sleeve 9 is provided with through hole 913 corresponding to the position of lock hole 52, and pin 162 is mounted in the through hole 913 through second spring 27, so that pin 162 is kept inserted into lock hole 52 and telescopic positioning hole 71 to lock an extended state of the movable column. Preferably, mounting groove 914 is arranged on positioning sleeve 9 at a position where through hole 913 is located, button 16 is arranged at an outer end of pin 162, and button 16 is hinged to an inner wall of mounting groove 914 by a pin shaft. Button 16 includes driving part 161, and there is gap 20 between driving part 161 and positioning sleeve 9. Second spring 27 is sleeved on the pin shaft hinged to the button 16, and two end extension portions of second spring 27 are respectively connected to positioning sleeve 9 and button 16, the gap between them is reduced after pressed by driving part 161 of button 16, so that the pin is pulled backwards away from the telescopic positioning hole, and the unlocking operation is completed. That is, the movable column can be telescoped to retract the movable column into the elongated cavity after the shelf is detached and the folding frame is folded, so that the volume of the folded barbecue tent body is greatly reduced, and it is more convenient to carry out.

Further, in order to achieve the resetting of driving part 161, positioning groove 915 is arranged on positioning sleeve 9, a slot is arranged on button 16, one end extension portion 271 of second spring 27 is placed in positioning groove 915, and the other end extension portion 271 is positioned in the slot. Driving part 161 is reset to facilitate subsequent pressing.

The present invention is not limited to the above preferred embodiment. Under the enlightenment of the present invention, anyone can derive other products in various forms, but regardless of any changes in its shape or structure, any technical solution that is the same or similar to the present application should fall within the protection scope of the present invention.

The invention claimed is:

1. An outdoor barbecue tent capable of quick assembling and folding, comprising a tent body and a shelf, wherein the tent body comprises a folding frame and at least two fixed columns arranged on the folding frame, a movable column is relatively movably mounted or detachably mounted on each of the at least two fixed columns; a supporting rod is mounted on the shelf, a lower end of the supporting rod away from the shelf is detachably connected to a first fixed column of the at least two fixed columns, and the shelf is detachably connected to the first fixed column, so that the shelf is mounted on the first fixed column;

wherein the shelf is provided with a shaft, and the first fixed column and a second fixed column of the at least two fixed columns are provided with perforations, and the shaft is correspondingly inserted into the perforations to position and connect the shelf; and a positioning component, wherein a connecting groove is arranged on the first fixed column, a first hole is arranged on an inner wall of the connecting groove, the other end of the supporting rod is provided with a second hole, and the positioning component is placed in the first hole and the second hole, for fixing a position state of the supporting rod and fixedly supporting the shelf;

wherein the positioning component comprises a pull ring and a rod, a first end of the rod close to the first fixed column is placed in the first hole and the second hole, the pull ring is arranged at the a second end of the rod away from the first fixed column, and the first end of the rod is mounted in the first hole after penetrating an elastic reset apparatus, the elastic reset apparatus comprises a lock sleeve located in a position area of the first hole and a first spring placed in the lock sleeve, a middle of the rod is placed in the lock sleeve, the second end of the rod penetrates through the lock sleeve, the middle of the rod is provided with a step, and two ends of the first spring respectively abut against the step and an inner wall of an end of the lock sleeve.

2. The outdoor barbecue tent capable of quick assembling and folding according to claim 1, further comprising another supporting rod mounted on the shelf, wherein the shelf is fitted with both supporting rods on both diagonal portions, or with both supporting rods on two opposite corners on one side of the shelf.

3. The outdoor barbecue tent capable of quick assembling and folding according to claim 2, wherein an outer end of the shaft is provided with a limiting body, and the diameter of the limiting body is greater than that of the perforations.

4. The outdoor barbecue tent capable of quick assembling and folding according to claim 3, wherein each perforation is in communication with a pre-insertion hole respectively, wherein each pre-insertion hole is arranged beside the respective perforation, the diameter of the pre-insertion hole is greater than that of the limiting body, and the diameter of the perforation is smaller than that of the pre-insertion hole.

5. The outdoor barbecue tent capable of quick assembling and folding according to claim 1, further comprising a positioning sleeve, wherein the connecting groove is arranged on the positioning sleeve, the first fixed column comprises an elongated cavity, the movable column is inserted into the elongated cavity from a lower end of the first fixed column, the positioning sleeve is sleeved on the lower end of the first fixed column, the lower end of the first fixed column is provided with a lock hole, at least one of the upper, middle, and lower ends of the movable column is provided with at least one telescopic positioning hole, positions of the lock hole and the telescopic positioning hole correspond to each other, and the first fixed column is provided with an elastic latch, the elastic latch comprises a pin and a second spring, the positioning sleeve is provided with a through hole corresponding to the position of the lock hole, and the pin is mounted in the through hole through the second spring, so that the pin is kept inserted into the lock hole and the telescopic positioning hole to lock an extended state of the movable column.

6. The outdoor barbecue tent capable of quick assembling and folding according to claim 5, wherein a mounting groove is arranged on the positioning sleeve at a position where the through hole is located, a button is arranged at an outer end of the pin, the button is hinged to an inner wall of the mounting groove through a pin shaft, the button comprises a driving part, and there is a gap between the driving part and the positioning sleeve; the second spring is sleeved on the pin shaft for the hinged to the button, and two end extension portions of the second spring are respectively connected to the positioning sleeve and the button.

7. The outdoor barbecue tent capable of quick assembling and folding according to claim 6, wherein the positioning sleeve is provided with a positioning groove, the button is provided with a slot, one end extension portion of the second spring is placed in the positioning groove, and the other end extension portion is located in the slot.

8. The outdoor barbecue tent capable of quick assembling and folding according to claim 1, wherein the supporting rod is provided with an oblique groove body, and a pointed portion is formed on a lower side of the oblique groove body of the supporting rod.

9. The outdoor barbecue tent capable of quick assembling and folding according to claim 1, wherein a hook is arranged on the shelf.

* * * * *